United States Patent [19]

Puckett

[11] Patent Number: 4,936,188

[45] Date of Patent: Jun. 26, 1990

[54] COMBUSTION SUB-CHANNELS FOR BULK LOADED LIQUID

[76] Inventor: Lawrence J. Puckett, 3106 Whitefield Rd., Churchville, Md. 21028

[21] Appl. No.: 406,931

[22] Filed: Sep. 13, 1989

[51] Int. Cl.[5] ..... F41F 1/04

[52] U.S. Cl. ..... 89/7; 89/8

[58] Field of Search ..... 89/7, 8

[56] References Cited

U.S. PATENT DOCUMENTS

| | | | |
|---|---|---|---|
| 176,276 | 4/1876 | Barnett | 89/8 |
| 200,740 | 2/1878 | Lyman | 89/8 |
| 407,476 | 7/1889 | Dudley | 89/7 |
| 429,592 | 6/1980 | Babcock | 89/7 |
| 484,007 | 10/1892 | Haskell | 89/8 |
| 484,011 | 10/1892 | Haskell | 89/8 |
| 1,661,091 | 2/1928 | Riabouchinski | 89/8 |
| 2,804,804 | 9/1957 | Cumming | 89/7 |
| 3,457,826 | 7/1969 | Stott | 89/8 |
| 4,337,685 | 7/1982 | Munding et al. | 89/7 |
| 4,602,553 | 7/1986 | Germershausen et al. | 89/7 |

*Primary Examiner*—David H. Brown

[57] ABSTRACT

Improved bulk-loaded liquid propellant guns are provided having a plurality of channels within the master chamber but not in contact with the gun barrel so as to obviate destructive pressure variances.

4 Claims, 1 Drawing Sheet

COMBUSTION SUB-CHANNELS FOR BULK LOADED LIQUID

BACKGROUND OF THE INVENTION

To applicant's knowledge, previous attempts to develop medium to large caliber bulk-loaded liquid propellant guns have been unsuccessful. Nevertheless the advantages of the use of a liquid propellant such as low cost, safety in handling, and ease of maximizing the formula for the particular conditions, etc., have caused ordinance engineers to search for a suitable gun design.

BRIEF SUMMARY OF THE INVENTION

In accordance with the invention, unlike previous designs, the pressure build-up in the combustion chamber is controlled by the use of multiple combustion channels contained within the combustion chamber but not in contact with the gun barrel to provide a pressure averaging effect. In this manner, the pressure provided to the combustion chamber is more uniform, i.e., the variances are not so great.

DETAILED DESCRIPTION OF THE INVENTION

Figure 1:
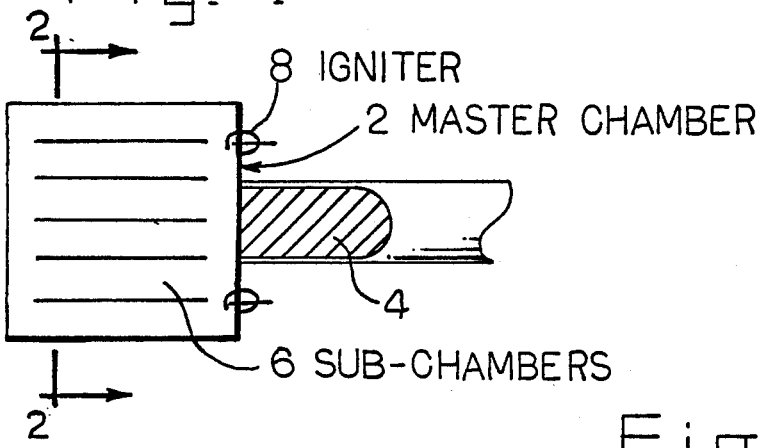
FIG. 1 is a side view of the master chamber and channels.
Figure 2:
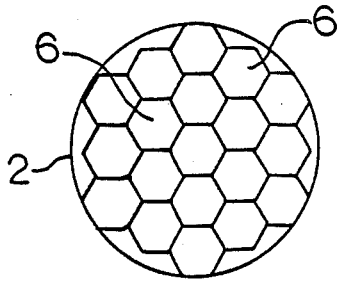
FIG. 2 is a cross-section of the channels taken across line A—A' in FIG. 1.

Referring now to FIG. 1, a side view of a liquid propellant gun is shown in which 2 is the master chamber, 4 is the projectile, 6, a channel, and 8, an igniter. Projectile 4 is shown within and surrounded by the gun barrel of the liquid propellant gun. In FIG. 2, a cross-section is shown taken along line 2—2 of the channels.

Figure 3:
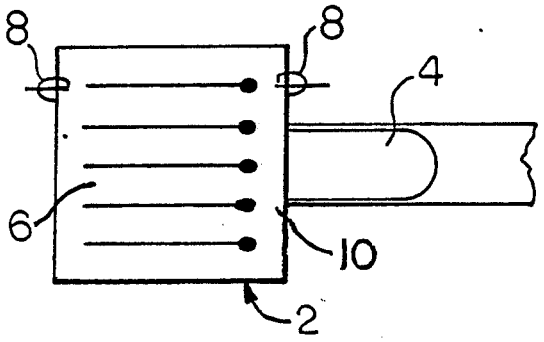
FIG. 3 is a side view of the channels with reduced area nozzles.

In FIG. 3, a preferred embodiment is shown in which reduced area nozzles, located in the forward ends of the channels, are used to achieve the forward ejection of the liquid propellant from the channels.

Figure 4:
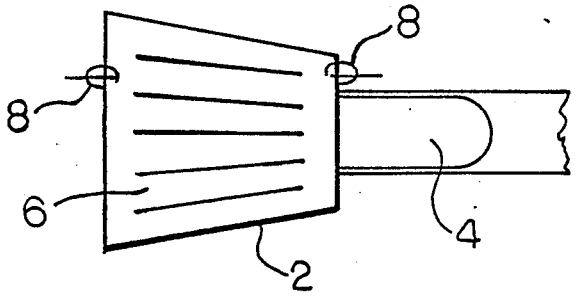
FIG. 4 is a side view of tapered channels.

In FIG. 4, a preferred embodiment is shown in which the channels are tapered with large areas aft and smaller areas forward. Both the nozzles and tapered channels can breakup or better disperse the liquid propellant droplets for more efficient distribution.

In operation, the master chamber is filled with liquid propellant which fills the channels as well. One or more igniters is then used to ignite the liquid propellant by in-chamber combustion as shown or by spray-injection combustion. Combustion proceeds in a rearward direction, entering and progressing through the channels, combusting the full charge of liquid propellant.

In-chamber combustion is illustrated in FIGS. 3 and 4. In this configuration, a dual igniter is used, first, to ignite the small volume of liquid propellant contained between the forward facing ends of the channels, and the aft end of the projectile, and, second, to ignite the aft end of the liquid propellant in the channel. This ignition sequence provides the impetus for the projectile to be set in motion by the front combustion process, creating a free-volume into which the propellant in the channels may be injected in reaction to pressurized aft ends. In order to achieve the forward ejection of the liquid propellant from the channels, a reduced-area nozzle (such as shown in FIG. 3) can be used in the forward ends of the channels, or the channels themselves may be tapered with large areas aft and smaller areas forward as shown in FIG. 4. The forced injection through the nozzles serves to break-up the liquid propellant droplets and spray.

A propellant suitable for this invention can be characterized as having about 20% water, 20% organic amine nitrate and 60% inorganic amine nitrate.

The igniters, spray nozzles and tapered channels can be made of conventional metals known to one of ordinary skill in the art. The size and total number of channels will depend on the pressure developed and other variables such as the strength and size of the master chamber. Each of the channels should be sufficiently small so that the total pressure produced is not greater than the master chamber can tolerate. The channels may be rigid if they are a fixed part of the master chamber, or mechanically flexible if they are a portion of the cartridge that contains the liquid propellant.

While the above is illustrative of the Best Mode and preferred embodiments, numerous variations may occur to one of ordinary skill and thus the invention is intended to be limited only by the appended claims.

What is claimed is:

1. In a bulk loaded liquid propellant gun comprising a master chamber, an igniter and a gun barrel, the improvement which comprises a plurality of interior combustion channels contained within the master chamber, said master chamber and the interior combustion channels therein are filled with a liquid propellant, and said interior combustion channels are not in contact with the gun barrel.

2. The liquid propellant gun of claim 1, wherein the interior combustion channels are such that the total pressure produced by ignition of the liquid propellant is not greater than the master chamber can tolerate.

3. The liquid propellant gun of claim 1, wherein said master chamber further comprises one or more igniters which are located at the forward end of the interior combustion channels in the space between the forward ends of said interior combustion channels and the rear of the gun barrel.

4. The liquid propellant gun of claim 1, wherein the interior combustion are tapered with large areas aft and smaller areas forward and closer to the gun barrel to better disperse the liquid propellant.

* * * * *

UNITED STATES PATENT AND TRADEMARK OFFICE

CERTIFICATE OF CORRECTION

PATENT NO. : 4,936,188

DATED : June 26, 1990

INVENTOR(S) : PUCKETT

It is certified that error appears in the above-identified patent and that said Letters Patent is hereby corrected as shown below:

On the cover sheet, the following has been added in the appropriate location:

-- Assignee: The United States of America as represented by the Secretary of The Army, Washington, D.C. --

-- Attorney, Agent, or Firm -- Saul Elbaum; Freda L. Krosnick --

Signed and Sealed this

Sixteenth Day of July, 1991

*Attest:*

*Attesting Officer*

HARRY F. MANBECK, JR.

*Commissioner of Patents and Trademarks*